US008548349B2

(12) United States Patent
Kastner

(10) Patent No.: US 8,548,349 B2
(45) Date of Patent: Oct. 1, 2013

(54) METHOD AND APPARATUS FOR LIFE EXTENSION OF OIL CONTAMINATED INTERMEDIATE TRANSFER BELTS

(75) Inventor: Evan P. Kastner, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 715 days.

(21) Appl. No.: 12/254,444

(22) Filed: Oct. 20, 2008

(65) Prior Publication Data

US 2010/0098454 A1 Apr. 22, 2010

(51) Int. Cl.
*G03G 15/16* (2006.01)

(52) U.S. Cl.
USPC ..... 399/101

(58) Field of Classification Search
USPC ..... 399/101
See application file for complete search history.

(56) References Cited

U.S. PATENT DOCUMENTS

| | | | | |
|---|---|---|---|---|
| 4,568,174 | A * | 2/1986 | Stange | 399/352 |
| 5,697,030 | A * | 12/1997 | Hayashi et al. | 399/299 |
| 2007/0147876 | A1* | 6/2007 | Moro et al. | 399/101 |
| 2007/0201897 | A1* | 8/2007 | Maeda et al. | 399/101 |
| 2008/0031647 | A1* | 2/2008 | Yoshikawa | 399/67 |

* cited by examiner

*Primary Examiner* — Walter L Lindsay, Jr.
*Assistant Examiner* — Barnabas Fekete
(74) *Attorney, Agent, or Firm* — Ronald E. Prass, Jr.; Prass LLP

(57) ABSTRACT

A method and apparatus that uniformly distributes a material on an image transfer surface is disclosed. The apparatus may include a circulation mechanism to circulate an image transfer surface in a two-dimensional manner around an axis and a retractable blade which is movable between a smoothing position contacting the material on the image transfer surface and a stand-by position departing from the material on the image transfer surface. Additionally, a cam on a lever moves the retractable blade to the stand-by position or to the smoothing position. In an image forming apparatus a retractable blade is used to smooth contamination of unknown distribution on a belt and to move corresponding to the movement of a roller disposed proximate to the belt.

10 Claims, 4 Drawing Sheets

METHOD AND APPARATUS FOR LIFE EXTENSION OF OIL CONTAMINATED INTERMEDIATE TRANSFER BELTS

BACKGROUND

The invention relates to a retractable blade for use in an electrophotographic image forming apparatus, particularly a retractable blade device that smoothes a material deposited on an image carrier by placing the blade adjacent to the surface of the image carrier.

In a typical electrostatographic reproducing apparatus such as an electrophotographic imaging system using a photoreceptor, a light image of an original to be copied is recorded in the form of an electrostatic latent image upon an imaging member and the latent image is subsequently rendered visible by the application of a developer mixture. One type of developer used in such printing machines is a liquid developer comprising a liquid carrier having toner particles dispersed therein. Generally, the toner is made up of resin and a suitable colorant such as a dye or pigment. Conventional charge director compounds may also be present. The liquid developer material is brought into contact with the electrostatic latent image and the colored toner particles are deposited thereon in image configuration.

Imaging members, i.e., photoreceptors, can take several forms including flexible belts, rigid drums, plates, and the like. Electrophotographic photoreceptors can be prepared with either a single layer configuration or a multilayer configuration. Multilayered photoreceptors may include a substrate support, an electrically conductive layer, an optional charge blocking or hole blocking layer, an optional adhesive layer, a charge generating layer, a charge transport layer, an optional protective or overcoating layer and, in some belt embodiments, an anticurl backing layer.

An Intermediate Transfer Belt (ITB) is used to compile an image or images originally developed on a primary surface or surfaces for subsequent transfer to a media substrate. Many programs experience shortened ITB life due to fuser oil contamination from duplexed media. The nature of many defects leading to replacement is observed to be as much a function of the non-uniformity of the oil distribution on the ITB as of the presence of oil itself. Many have suggested methods for removing oil from media prior to duplex transfer or from contaminated ITBs and photoreceptors, either as a process step or a service cleaning action. While the presence of oil is undesirable and even a uniform distribution may still lead to ITB replacement, a substantial subset of customers tolerate images printed with a smoothed contamination distribution.

For the reasons stated above, and for other reasons stated below which will become apparent to those skilled in the art upon reading and understanding the present specification, there is a need in the art to uniformly distribute a contaminant on a belt to extend the useful life of the belt.

SUMMARY

A method and apparatus that uniformly distributes a material on an image transfer surface is disclosed. The apparatus may include a circulation mechanism to circulate an image transfer surface in a two-dimensional manner around an axis and a retractable blade which is movable between a smoothing position contacting the material on the image transfer surface and a stand-by position departing from the material on the image transfer surface. Additionally, a cam on a lever moves the retractable blade to the stand-by position or to the smoothing position.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Figure 1:
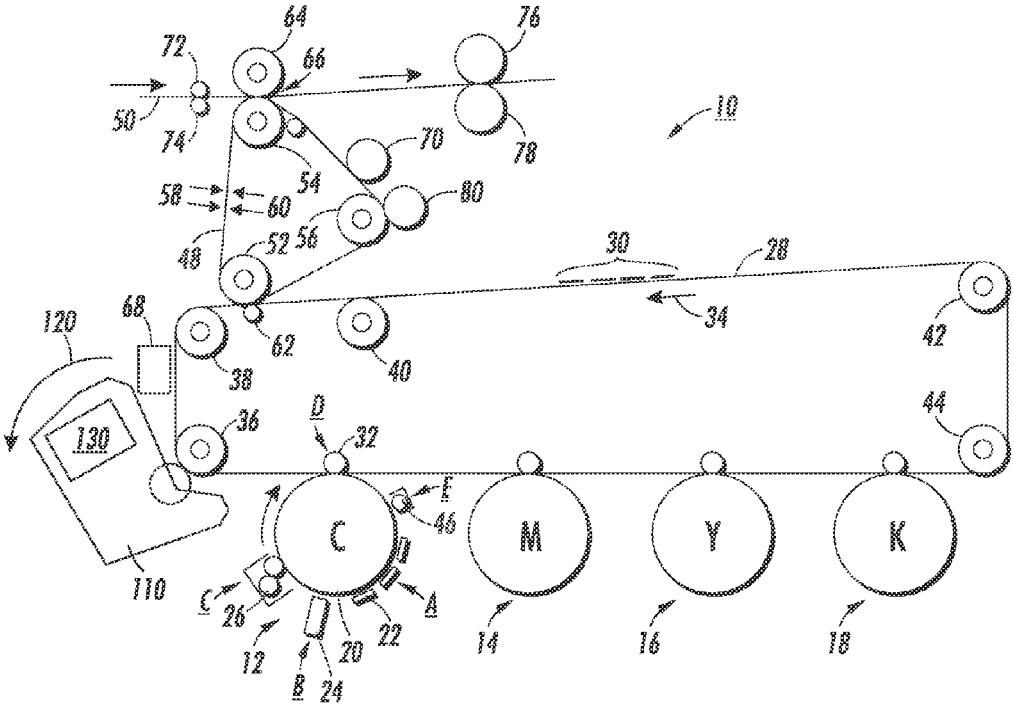
FIG. 1 is a schematic representation in cross-section of an automatic electrostatographic printing machine in accordance to a possible embodiment.

Additional features and advantages of the invention will be set forth in the description which follows, and in part will be obvious from the description, or may be learned by practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth herein.

Various embodiments of the invention are discussed in detail below. While specific implementations are discussed, it should be understood that this is done for illustration purposes only. A person skilled in the relevant art will recognize that other components and configurations may be used without parting from the spirit and scope of the invention.

The invention comprises a variety of embodiments, such as a method and apparatus and other embodiments that relate to the basic concepts of the invention.

This invention concerns the smoothing of fuser oil contamination on belts in order to extend the life of the belt.

The disclosed embodiments include a circulation mechanism to circulate the image transfer surface in a two-dimensional manner around an axis, wherein the material is randomly distributed to the image transfer surface, and a retractable blade which is movable between a smoothing position contacting the material on the image transfer surface and a stand-by position departing from the material on the image transfer surface. The retractable blade in combination with the image transfer surface uniformly distributes a material such as fuser oil to extend the life of an image transfer mechanism such as belt.

The disclosed embodiments further include a method for uniformly distributing a material on an image transfer surface in an image transfer device by circulating the image transfer surface in a two-dimensional manner around an axis, wherein the material is randomly distributed to the image transfer surface; and moving a retractable blade between a smoothing position contacting the material on the image transfer surface and a stand-by position departing from the material on the image transfer surface.

The disclosed embodiments still further include an image forming apparatus with a belt to receive developer, a roller disposed proximate to the belt to move in a tension-adjusting direction to change an amount of tension of the belt, and a retractable blade to smooth contamination on the belt, optimally placed after a process of cleaning untransfered toner from the belt, and to move corresponding to the movement of the roller.

The term imaging surface or imaging member is any member, such as a roll or a belt, defining a surface in which marking material, such as toner or liquid ink, is placed in imagewise fashion for subsequent transfer to a print sheet or another imaging member. The imaging member can be photosensitive, such as a xerographic or electrostatographic photoreceptor; or can be non-photosensitive, such as an intermediate belt (ITB) or drum used in xerographic, ink-jet, or offset printing technology.

FIG. 1 is a schematic representation in cross-section of an automatic electrophotographic printing machine or image forming apparatus in accordance to a possible embodiment.

As illustrated in FIG. 1, an image forming apparatus such as a color printer 10 utilizes a plurality of xerographic imaging stations 12, 14, 16 and 18. Each station includes charge retentive surface such as a photoreceptor drum 20, preferably comprising an Active Matrix (AMAT) construction. Each drum is supported in a conventional manner for rotation in an endless path such that each portion thereof moves past or through a charging station A, exposure station B, development station C, image transfer station D and cleaning station E.

As portions of each drum move past a charging device such as an Aquatron or Di-scorotrons 22 or the like positioned at the charging station A they are provided with a uniform electrostatic charge. An Aquatron is a liquid charging device that is an ozone-free contact charging technique based on the electrification of a water contact to the photoreceptor surface. Its advantage over other contact charging techniques is that it provides excellent charging uniformity over a wide range of process speeds, e.g. to 50 ips, using a DC-only voltage. Furthermore, it is nearly 100% efficient, operating at near theoretical voltage and current levels. After the drum is uniformly charged it is exposed to a laser based output scanning device 24 operatively supported adjacent the drum at the exposure station B. At exposure B the scanning device 24 illuminates a uniformly charged area of the drum with a light corresponding to a first separation color of an image being reproduced thereby selectively discharging the drum to form a first latent electrostatic image which is developed at the first imaging 12 station with cyan toner. Such development is effected using a suitable developer structure 26. In like manner Magenta, Yellow and black images are formed at the imaging stations 14, 16 and 18, respectively.

The cyan, magenta, yellow and black images are sequentially transferred to an Intermediate Transfer Belt (ITB) 28 to form composite color images 30 on the ITB, the cyan image being transferred thereto at the transfer station D. Image is transferred electrostatically using an electrically biased transfer roller 32. The ITB is supported for endless movement, in the direction of the arrow 34, about a plurality of rollers 36, 38, 40, 42 and 44. A conventional belt drive mechanism, not shown, is operatively connected to one of the rollers, say roller 36 for imparting motion to the ITB. Timing detectors (not shown) sense the movement of the intermediate belt 28 and communicate with machine logic circuits and other drive mechanism (not shown) to synchronize the various operations so as to ensure registration and image quality metrics are observed. Not every image created utilizes all four of the colors provided. Others may use six or more colors. Thus, controls, not shown, are provided for selective operation of the imaging stations.

Residual toner particles as well as debris are removed from the charge retentive drums at each imaging station using a suitable xerographic cleaning device such as an electrostatically biased roll structure 46. Other suitable cleaning structures comprise one or more cleaning blades, not shown.

The composite images 30 are transferred to a transfuse belt 48. A transfuse belt is one that simultaneously transfers and fuses toner images to a substrate such as sheet of plain paper 50. The transfuse belt is supported for movement in a clockwise endless path by a plurality of support rollers 52, 54 and 56. Transfuse belt movement is controlled using a drive mechanism, not shown, that may be operatively coupled to one of the support rollers 52, 54 or 56. Other systems (not shown) consist of a secondary transfer belt forming a nip with the ITB through which an image is transferred to a media substrate and subsequently transported to an independent fusing unit (again, not shown) utilizing some combination of heat and pressure to achieve image permanence.

Figure 2:
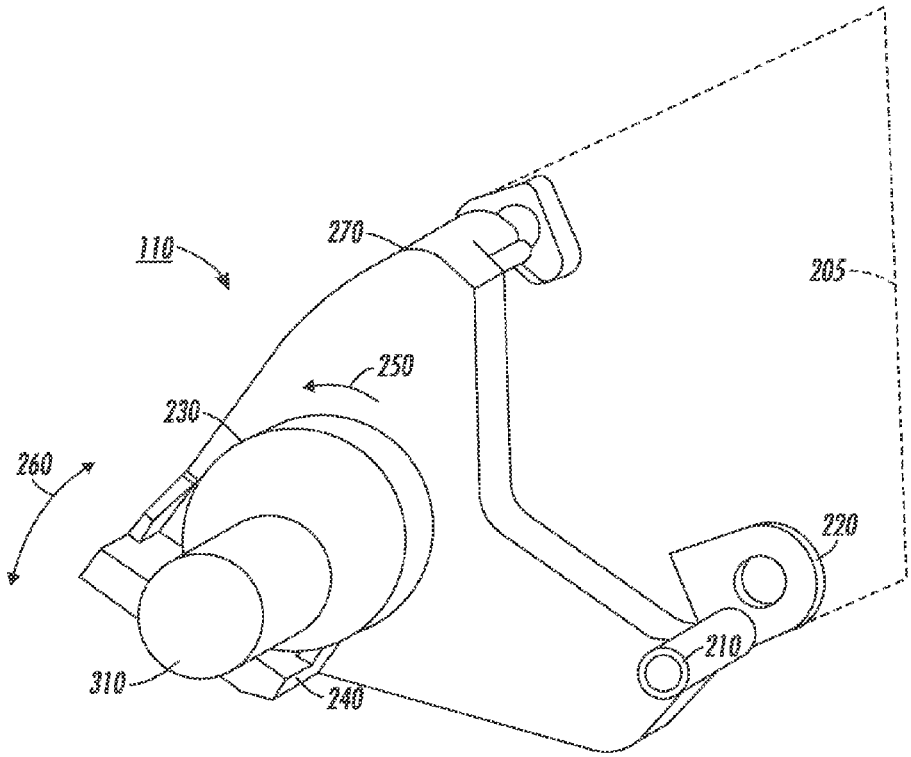
FIG. 2 is a perspective view of an apparatus with retractable blade for uniformly distributing a material on an image transfer surface in accordance with a possible embodiment of the invention.
Figure 3:
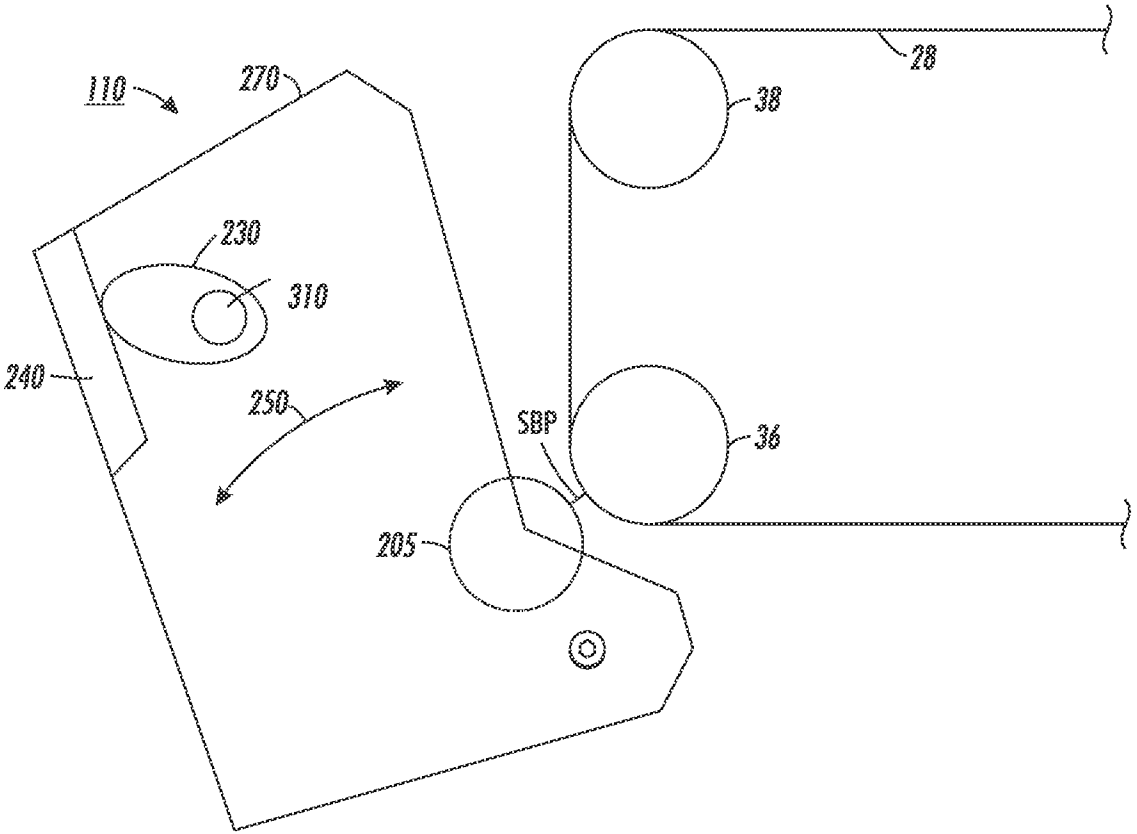
FIG. 3 schematic side view of the portion of the apparatus for uniformly distributing a material to describe an operating process of the retractable blade so that the blade may be in a stand-by position in accordance with a possible embodiment of the invention.
Figure 4:
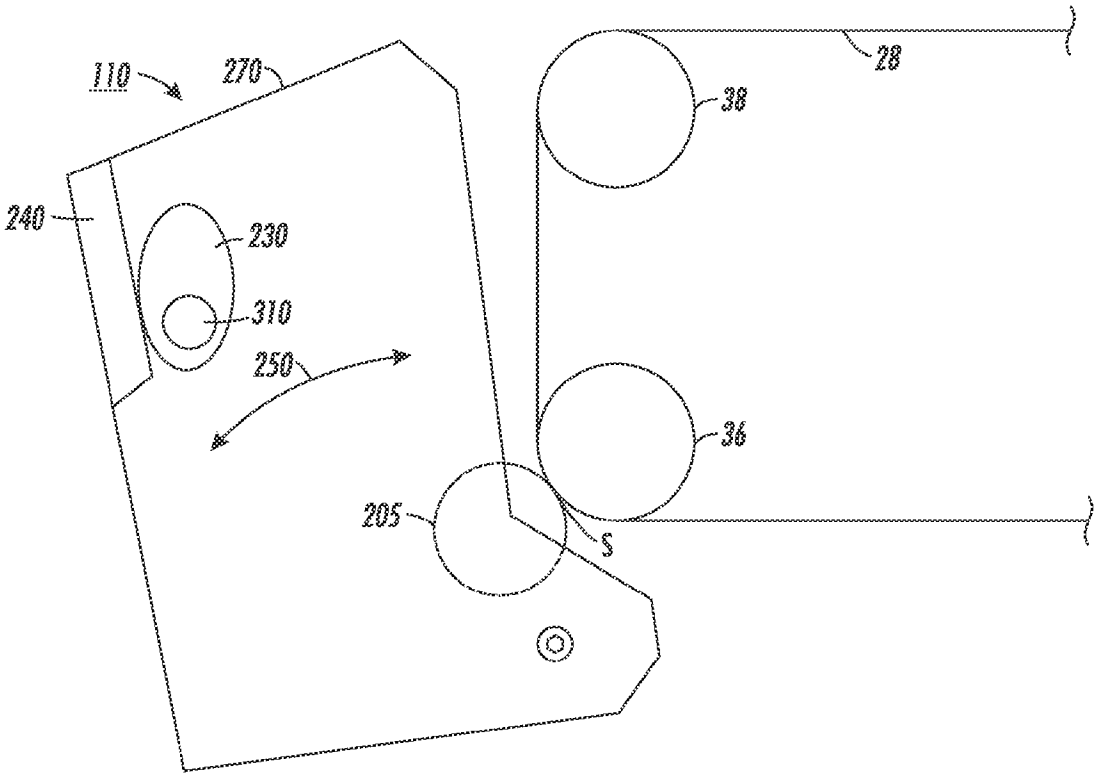
FIG. 4 schematic side view of the portion of the apparatus for uniformly distributing a material to describe an operating process of the retractable blade so that the blade may be in a smoothing position in accordance with a possible embodiment of the invention.

The temperature of the transfuse belt 48 is preferably elevated using suitable heating devices well known in the xerographic arts. The transfuse belt may be heated either externally and/or internally at various locations about the extent of the belt. By internally, is meant that the heat source is positioned within the loop made by the belt 48 while externally means that the heat source is positioned outside of the loop created by the belt. The source of heat may be radiant or contact or a combination of both. By way of example, an external heat source depicted schematically by arrows 58 may be positioned adjacent the transfuse belt as shown in order to heat the belt prior to image transfer from the transfuse belt to the substrate 50. An internal heat source depicted schematically by arrows 60 may also be utilized depending on the requirements of the apparatus in which the transfusing arrangement of the present invention is utilized. An internal heat source (not shown) can alternatively be mounted inside 52, 54, and/or 56. Transfer of toner images from the ITB 28 to the transfuse belt 48 may be electrostatically assisted using a biased fuser roller 62. Fuser roller introduces a fuser oil contamination that may or may not be randomly distributed on the belts such as the intermediate transfer belt. This oil contamination leads to belt wear and to reduction of image quality (IQ). However, the nature of many defects leading to replacement of belts is observed to be as much a function of the non-uniformity of the oil distribution on the ITB as of the presence of oil itself. The cost of development and implementation of an oil cleaning unit may be prohibitive. An apparatus 110 with retractable blade can be engaged or turned 120 to a position where the oil contaminant is smooth to minimize the non-uniformity of the oil contamination. The apparatus 110 includes a cam driving unit 130 for driving a cam, as shown in FIGS. 2-4.

A backup roller 64 is provided for creating a nip 66 with the support roller 54 through which the transfuse belt 48 passes. A force is applied to the backup roller 64 in a well known manner to thereby create pressure in the nip 66 to enable transfer of toner images from the transfuse belt 48 to a substrate 50 as the substrate passes through the nip 66. The support roller 54 may be electrically biased for assisting in the transfer of toner images to the substrate 50.

Once the composite toner images are transferred from the ITB 28 to the transfuse belt 48, residual toner particles and debris are removed from the ITB using a well known cleaning member 68 not forming a part of the present invention. The cleaning structure of an ITB may comprise of a blade cleaner but is more typically comprised of one or more electrically biased brushes. Likewise, once the toner images have been transferred to the substrate 50, residual toner particles and debris are removed from the transfuse belt 48 using one or more sticky rollers 70 contacting the surface of the belt 48 downstream of the nip 66. A sticky roller is a system that has a sticky surface at an elevated temperature to which toner particles and debris readily adhere upon contact with such material surface.

The substrate 50 may be heated prior to its passage through the nip 66. To this end, there is provided a pair of heat and pressure rollers 72 and 74, one or both of which may be heated for elevating the temperature of the substrate 50. The paper is preferably preheated by the rollers 72 and 74 to a temperature for example, of about 80 degrees C. Preheating of the substrate 50 permits operation of the transfuse belt at a substantially lower transfusing temperature. For example, when the substrate 50 is preheated to a temperature of about 80 degrees C. the transfuse belt which in the absence of preheating would be elevated to a temperature of about 140 to 160 degrees C. would only have to be elevated to a temperature in the order of 100 to 120 degrees C. Of course, these temperatures will increase or decrease depending on the softening and melting characteristics of the toner. By reducing the required operating temperature of the transfuse belt, the life of the belt is thereby substantially extended.

Toner image gloss enhancement may be provided using a pair of heat and pressure rollers 76 and 78 that are similar in construction to a conventional roll fuser. Variable as well as operator selected print gloss may be provided according to prior art techniques and therefore does not form a part of the present invention.

The transfuse belt 48 may be fabricated using any suitable material such as silicone rubber. The belt thickness is preferably about 1 mm and has a circumferential extent of, for example, 20 inches. As will be appreciated, a transfuse belt having such a relatively large circumference provides for high speed transfusing as well as a convenient size for accommodating the various devices for implementing the transfuse feature.

While a release agent material is not required for satisfactory operation of the transfuse belt a Release Agent Management (RAM) system for applying a release agent material such as silicone oil may be utilized for applying silicone oil to the transfuse belt surface. A RAM system utilized for this purpose comprises a donor roll 80. For sake of clarity, the other components of RAM system have been omitted. By the application of about 0.1 milligrams of silicone oil per sheet of paper, the transfuse belt life may be appreciably extended.

The ITB 28 is preferably fabricated from a polymer material such as polyimide, polycarbonate or the like. This belt may be fabricated in accordance with well known manufacturing processes such as extruding, is molding and casting. The belt thickness is for example about 80 microns. The belt may be either seamless of seamed but preferably comprises a seamless structure. The ITB can be a single layer or a multiple layer structure.

The ITB thermally isolates the imaging stations from the heat of the transfuse member. Therefore the transfuse member can operate at a relatively higher temperature without the potential to damage the imaging components such as photoreceptors or impact toner properties within developer housings. Because the transfuse member can be maintained at a higher temperature, the transfuse member can be relatively thick. Thick transfuse members are generally preferred over thin members for a number of reasons. For example release of melted toner and stripping of a copy sheet from a toner fixing surface can be significantly assisted by employing shear stresses in the fixing surface in the high pressure transfer nip that are generally referred to as "creep". The desired optimum creep for self stripping of a document and for good operating latitude for toner release generally requires a rubber over layer in the range of 0.5 mm to greater than 1 mm. A thick belt is also desired for creating a high degree of conformance to enable good transfer and fix in the transfer nip when rough papers are used. A thick transfuse belt thus generally has more media latitude than a thin transfuse belt. Thick transfuse members are also desired over thin members for achieving higher operational life. Finally, thick over layers are highly advantaged for transfuse systems that may wish to achieve low gloss in the transfer nip and employ an optional post transfuse gloss enhancing system to allow operators to optionally choose high or low gloss print output. The resistivity of the material used for the ITB should be such that high voltage drops across the intermediate transfer are avoided.

FIG. 2 is a perspective view of an apparatus 110 with retractable blade for uniformly distributing a material on an image transfer surface in accordance with a possible embodiment of the invention. Apparatus 110 may include a retractable blade 205, a lever 270, a cam 230, a cam shaft 310 and a cam driving unit (not shown) to rotate 250 the cam 230. Retractable blade 205 is made from a polyurethane material such as nylon or plastic. The retractable blade 205 is coupled to a supporting member and guiding member to keep the blade in place. The lever 270 has a cam contact protrusion 240, the rotating center protrusion 210 and the supporting member protrusion 220. The cam contact protrusion 240 is protruded toward the cam 230 so that it can be selectively contacted by the cam 230. The lever 270 can be used to move 260 the retractable blade 205 between a smooth position, where it situates the retractable blade 205 in proximity to the belt 28 but where the contaminating material can be spread as a function of the relative distance between the belt 28 and the retractable blade 205. The lever 270 can move 260 the retractable blade 205 to a stand-by position where it sets the retractable blade 205 at a distance away from the belt 28 and not in contact with the contaminating material. Accordingly, a user can manually operate the lever 270 to selectively smooth the material on the belt 28. This selectivity can be based on image quality (IQ) or on a periodic maintenance schedule.

FIG. 3 illustrates a schematic side view of the portion of the apparatus 110 for uniformly distributing a material to describe an operating process of the retractable blade 205 so that the retractable blade 205 may be in a stand-by position in accordance with a possible embodiment of the invention. As illustrated in FIG. 3, if the cam 230 contacts the cam contact protrusion 240 to rotate the lever 270 counterclockwise 250, a blade supporting member also rotates counterclockwise in connection with lever 270. Accordingly, the retractable blade 205 departs from a direction of the belt 28 to move to the stand-by position SBP.

FIG. 4 illustrates a schematic side view of the portion of the apparatus 110 for uniformly distributing a material in accordance with a possible embodiment. In particular, the retractable blade 205 can be placed in a smoothing position in accordance with a possible embodiment of the invention. Position as used herein is inclusive of displacement from the belt 28, pitch or angle relative to the surface of the retractable blade 205 and belt 28, and force that the retractable blade 205 can absorb when in contact with the contaminating material. In FIG. 4, the cam 230 does not contact the cam contact protrusion 240, so that a retractable blade 205 attached to a blade supporting member rotates clockwise in the direction of belt 28. A pivot mechanism such as a hinge coupled to the lever 270 allows the blade supporting member to rotate in the same direction as lever 270 towards the direction of belt 28. A restoring force such as from a spring mechanism causes the retractable blade 205 positioned in the blade supporting member to rotate clockwise so that the retractable blade 205 can be stably located at the smoothing position S.

Although the above description may contain specific details, they should not be construed as limiting the claims in any way. Other configurations of the described embodiments of the invention are part of the scope of the disclosed embodiments. For example, the principles of the disclosed embodiments may be applied to each individual user where each user may individually deploy such a system. This enables each user to utilize the benefits of the disclosed embodiments even if any one of the large number of possible applications do not need the functionality described herein. In other words, there may be multiple instances of the component in the disclosed embodiments each processing the content in various possible ways. It does not necessarily need to be one system used by all end users. Accordingly, the appended claims and their legal equivalents should only define the disclosed embodiments, rather than any specific examples given.

I claim:

1. An electrophotographic marking system to uniformly distribute a material that is separately disposed on an image transfer surface, comprising:

a circulation mechanism to circulate the image transfer surface in a two-dimensional manner around an axis, the material being randomly disposed on the image transfer surface; and an apparatus comprising:

a retractable blade which is movable between a smoothing position contacting the material that is separately disposed on the image transfer surface while not contacting the image transfer surface, and a stand-by position departing from the material separately disposed on the image transfer surface, the retractable blade uniformly distributing the material on the image transfer surface when in the smoothing position in a manner that does not remove the material from the image transfer surface;

a supporting member which supports the retractable blade;

a member which rotatably supports the supporting member about a retractable blade rotating axis parallel with circulating image transfer surface;

a lever which rotates in connection with the supporting member;

a cam on the lever so that the retractable blade can move to the stand-by position or to the smoothing position; and a cam driving unit which drives the cam to rotate.

2. The electrophotographic marking system according to claim 1, wherein the circulation mechanism is an intermediate transfer belt.

3. The electrophotographic marking system according to claim 1, wherein the retractable blade is polyurethane blade.

4. The electrophotographic marking system according to claim 3, wherein the retractable blade smoothes the material on the image transfer surface.

5. A method for uniformly distributing a material that is separately disposed on an image transfer surface in an electrophotographic marking system, comprising:

circulating the image transfer surface in a two-dimensional manner around an axis, the material being randomly disposed on the image transfer surface; and moving a retractable blade between a smoothing position contacting the material that is separately disposed on the image transfer surface while not contacting the image transfer surface, and a stand-by position departing from the material separately disposed on the image transfer surface, the retractable blade uniformly distributing the material on the image transfer surface when in the smoothing position in a manner that does not remove the material from the image transfer surface, the retractable blade being supported on a supporting member which is in turn rotatably supported by a member about a retractable blade rotating axis parallel with circulating image transfer surface, the moving of the retractable blade being by manipulation of a cam on a lever that rotates in connection with the supporting member under control of a cam driving unit that rotates the cam.

6. The method of claim 5, the image transfer surface being on an intermediate transfer belt.

7. The method of claim 5, the retractable blade being a polyurethane blade.

8. The method of claim 7, wherein the retractable blade smoothes the material on the image transfer surface.

9. An image forming system, comprising:

a belt to receive developer;

a roller disposed proximate to the belt to move in a tension-adjusting direction to change an amount of tension of the belt; and an apparatus with a retractable blade to smooth contamination material separately disposed on the belt and to move corresponding to the movement of the roller, the retractable blade uniformly distributing the contamination material when in a smoothing position in a manner that does not remove the material from the image transfer surface, the apparatus moving the retractable blade between a smoothing position contacting the contamination material separately disposed on the belt while not contacting the belt and a stand-by position departing from the contamination material on the belt, the apparatus further comprising:

a supporting member which supports the retractable blade, a member which rotatably supports the supporting member about a retractable blade rotating axis being parallel with the belt, a lever which rotates in connection with the supporting member, a cam on the lever so that the retractable blade can move to the stand-by position or to the smoothing position, and a cam driving unit which drives the cam to rotate.

10. The image forming system according to claim 9, the belt being an intermediate transfer belt, the retractable blade being a polyurethane blade, and the retractable blade smoothing the material on the belt.

* * * * *